United States Patent [19]

Fukase et al.

[11] Patent Number: 4,784,208

[45] Date of Patent: Nov. 15, 1988

[54] DUAL ROLL TYPE CONTINUOUS CASTING MACHINE

[75] Inventors: Hisahiko Fukase, Tokyo; Kunio Matsui; Akihiro Nomura, both of Yokohama; Kenji Matsuda, Matsudo; Atsushi Hirata, Hiratsuka, all of Japan

[73] Assignee: Ishikawajima-Harima Jukogyo Kabushiki Kaisha, Japan

[21] Appl. No.: 168,696

[22] Filed: Mar. 16, 1988

[30] Foreign Application Priority Data

Mar. 24, 1987 [JP] Japan ..... 62-69596

[51] Int. Cl.[4] ..... B22D 11/06

[52] U.S. Cl. ..... 164/428; 164/480

[58] Field of Search ..... 164/428, 480

[56] References Cited

U.S. PATENT DOCUMENTS 4,694,887 9/1987 Matsui et al. ..... 164/428

*Primary Examiner*—Kuang Y. Lin

[57] ABSTRACT

Cut-out portions or horizontal passages in the form of an inverted T are provided to melt solidified shells grown at triple points at which side seal plates, colling rolls and molten metal are made contact with each other. Pouring holes or slits are provided for inside pouring. Length of the slit in the cast widthwise direction is preliminarily determined so as to maintain temperature distribution in molten bath uniformly. Start of a continuous casting operation is facilitated by movable baffer plates disposed at open ends of the horizontal passage.

9 Claims, 5 Drawing Sheets

DUAL ROLL TYPE CONTINUOUS CASTING MACHINE

BACKGROUND OF THE INVENTION

The present invention relates to a dual roll type continuous casting machine for continuously casting a strip.

As shown in FIG. 1, a dual roll type continuous casting machine has a pair of cooling rolls 1 in parallel with each other and spaced apart from each other by a suitable distance as shown in FIG. 1. Side seal plates 2 are disposed at the ends of the cooling rolls 1 to define a molten bath or pool 13 (in some cases, barrel seal plates are disposed, extending in the axial direction of the cooling rolls 1). Molten metal is poured into the molten bath 13 and is cooled by the cooling rolls 1 which are rotated in the directions indicated by the arrows so that a cast 3 continuously emerges out of a roll gap between the rolls 1.

Solidified shells are developed over the surfaces of the cooling rolls 1 as the molten metal in the molten bath 13 is cooled by the cooling rolls 1. Abnormal growth of the solidified shells is observed at the so called triple points (i.e., the points of contact between the cooling roll 1, the side seal plate 2 and the molten metal) since the molten metal tends to tarry and thus tends to be sooner cooled at the triple points. The abnormally grown solidified shells are pulled by the solidified shells developed on the cooling rolls 1 and drops (are separated) into the gap between the cooling rolls 1. As a result, not only the surfaces of the cast may be degraded, but also the thickness of the cast may be increased locally, causing breakdown of the same. In addition, drop of the abnormally grown solidified shells may cause damages on the side seal plates 2.

To overcome such triple-point problem, it has been devised and demonstrated to pour the molten metal 5 into a core 4 disposed in the molten bath and to cause the same to flow through holes 6 on the core 4 into the gap between the cooling rolls 1 for prevention of the abnormal growth of the solidified shells at the triple points.

However, even the above-described system cannot satisfactorily overcome in practice the triple point problem because it is impossible to effectively melt only the harmful solidified shells grown at the triple points. More specifically, when the molten metal is directed to flow directly toward the triple points, not only the solidified shells at the triple points but also the solidified shells on the cooling rolls are melted.

In view of the above, according to the present invention, of the solidified shells grown at the triple points, only the solidified shell which are harmful and are grown at the side seal plate is effectively melted away.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
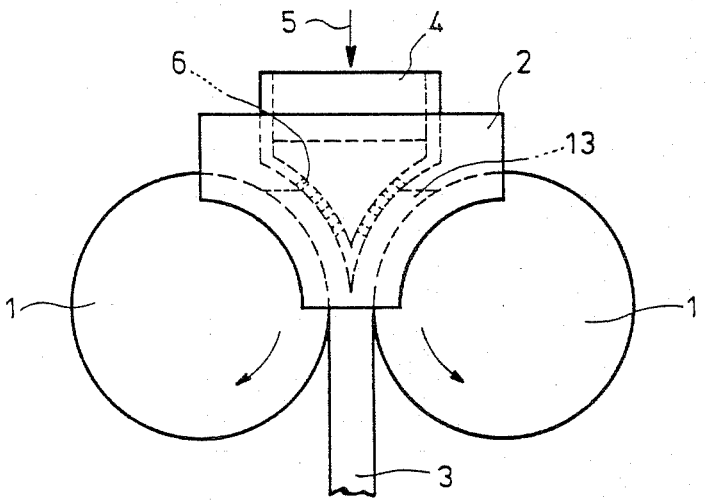
Fig. 1 PRIOR ART
FIG. 1 is a schematic side view of a conventional dual roll type continuous casting machine.
Figure 2:
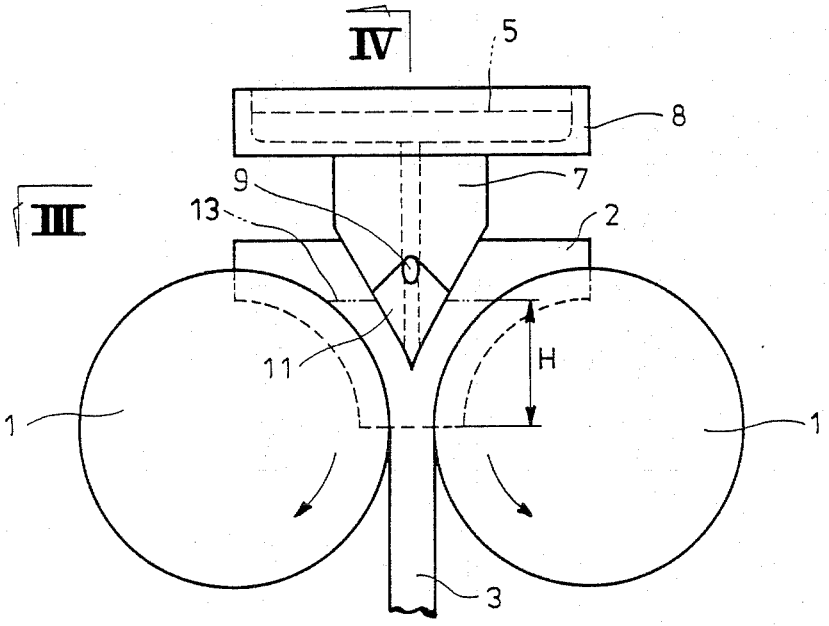
FIG. 2 is a schematic side view of a first embodiment of the present invention.
Figure 3:
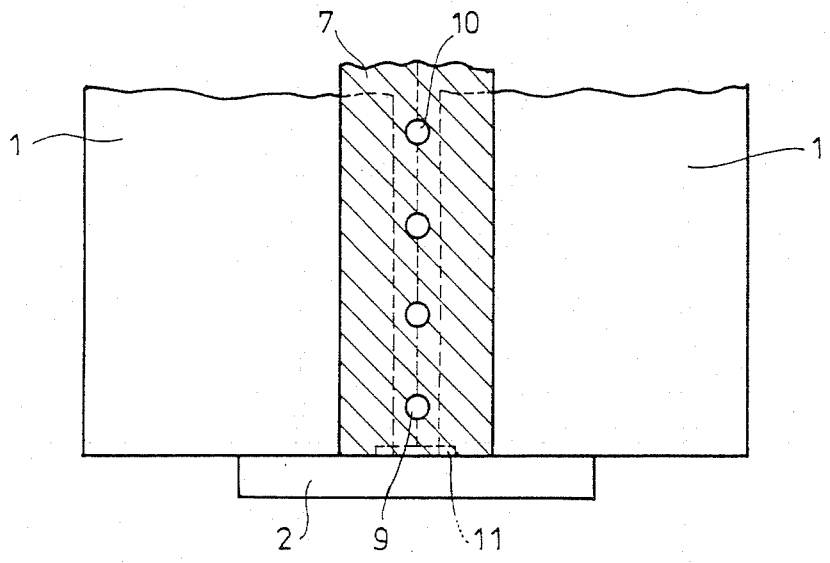
FIG. 3 is a sectional view looking in the direction indicated by an arrow III in FIG. 2.
Figure 4:
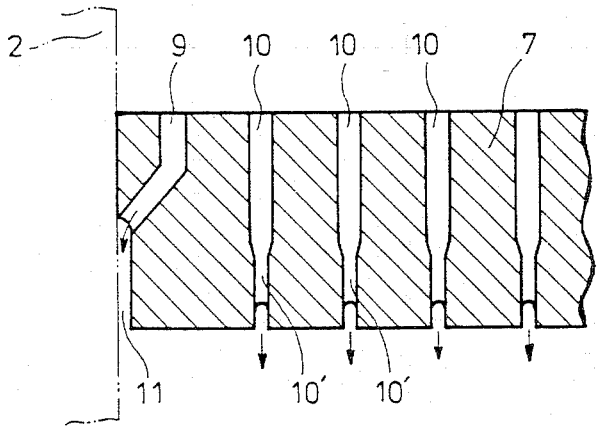
FIG. 4 is a sectional view looking in the direction indicated by an arrow IV in FIG. 2.

First referring to FIGS. 2–4, a first embodiment of the present invention will be described. Side seal plates 2 are disposed at opposite longitudinal ends of cooling rolls 1 to define a molten bath or pool 13 on the rolls 1. A V shaped core 7 is accommodated in the molten bath 13 between the side seal plates 2. Molten metal 5 within a tundish 8 formed integral with an upper portion of the core 7 flows through side pouring holes 9 which are formed adjacent to the opposite ends of the core 7 in the longitudinal direction thereof (the widthwise direction of the cast 3) so that the molten metal 5 is supplied toward the side seal plates 2. Furthermore, in order to directly pour the molten metal 5 from the tundish 8 into the gap between the cooling rolls 1, a plurality of vertical inside pouring holes 10 which open to a V shaped leading or lower end of the core 7 are formed through the longitudinal intermediate portion between the ends of the core 7 and are spaced apart from each other by a predetermined distance. Each of the pouring holes 10 has a reduced-diameter portion 10' so as to retard the flow of the molten metal 5.

The side pouring holes 9 opens to the corresponding longitudinal end of the core 7 and terminates in a cut-out portion 11 to define a passage through which the molten metal 5 flow along the side seal plate 2 toward an abutment between the side seal plate 2 and the cooling plate.

Thus, the molten metal 5 from the side pouring hole flows along the side seal plate 2 due to the cut out portion 11 toward the abutment (the position of the triple point) between the side seal plate 2 and the cooling roll 1 so that the undesired solidified shell grown on the surface of the side seal plate 2 can be melted.

The molten metal 5 flowing out of the inside pouring holes 10 is directly supplied to the gap between the cooling rolls 1 and the solidified shells grown over the cylindrical surfaces of the cooling rolls 1 are not melted.

Therefore, growth of the solidified shell over the cylindrical surface of each cooling roll 1 is accelerated while growth of the solidified shells over the surfaces of the side seal plates 2 is prevented so that a high quality cast 3 can be obtained.

In the first embodiment described above, in order to prevent the solidification at the upper surface of the molten metal in the molten bath 13 due to residence or retardation of the molten metal, it is very effective that the depth H of the molten metal in the molten bath is shallowed.

Figure 5:
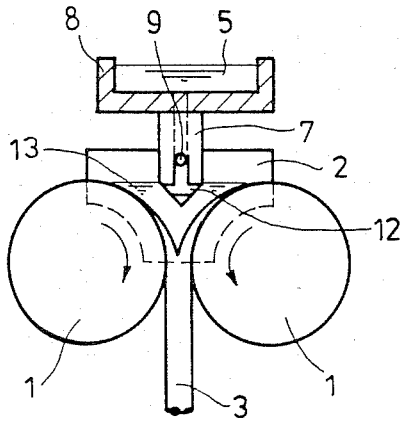
FIG. 5 is a schematic side view of a second embodiment of the present invention.

Next referring to FIG. 5, a second embodiment of the present invention will be described. The second embodiment is substantially similar in construction to the first embodiment described above except that the core 7 is formed, at its respective longitudinal end abutting on the side seal plate 2, with a horizontal passage 12 which is in the form of an inverted T for communication with the side pouring hole 9 and extends horizontally and oppositely to open at positions slightly lower than a normal surface level of the molten metal in the molten bath 13. In the second embodiment, the molten metal 5 poured from the tundish 8 into the core 7 is supplied through the horizontal passages 12 to the triple points in the molten bath 13 so that abnormal growth of the solidified shells at the triple points can be prevented. The horizontal flows of the molten metal 5 into the molten bath 13 due to the horizontal passages 12 reduce the possibility of the solidified shells for the cast 3 below the core 7 being influenced by the molten metal flows.

Figure 6:
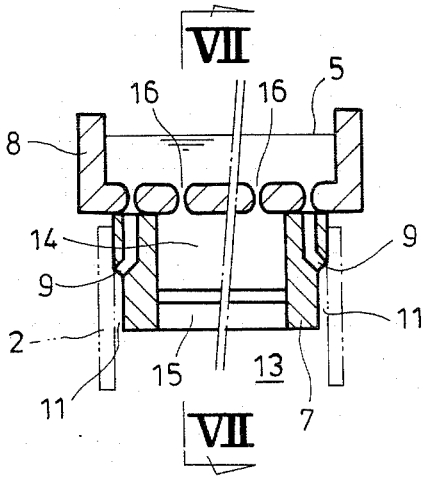
FIG. 6 is a schematic view of a third embodiment of the present invention.
Figure 7:
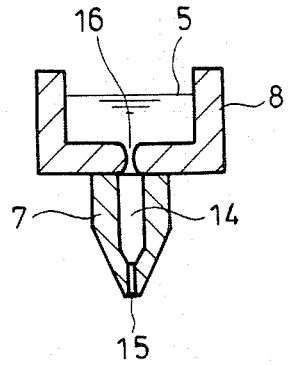
FIG. 7 is a sectional view taken along the line VII—VII in FIG. 6.

Referring next to FIGS. 6 and 7, a third embodiment of the present invention will be described. The third embodiment is substantially similar in construction to the first embodiment described above except that provided in lieu of the inside pouring holes 10 and their reduced diameter portions 10' defined in the core 7 are an upper slit 14 and a lower slit 15 which is narrower in width than the upper slit 14. The upper slit 14 is communicated with major pouring holes 16 which control the flow rate of the molten metal from the tundish 8.

In the third embodiment, the upper slit 14 serves as inner molten bath and the flow rate of the molten metal flowing out of the major pouring holes 16 becomes uniform and gentle so that the molten metal is gently poured in the form of a sheet without causing clogging into the molten bath 13. Therefore, prevented are melting of the solidified shells growing over the cylindrical surfaces of the cooling rolls 1 as well as disturbance of the surface level of the molten metal in the bath.

In the third embodiment, instead of each cut-out portion 11, the horizontal passage 12 may be employed as in the case of the second embodiment.

Figure 8:
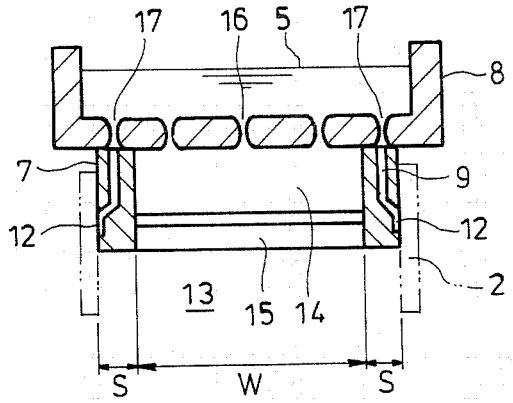
FIG. 8 is a schematic view of a fourth embodiment of the present invention.

FIG. 8 shows a fourth embodiment of the present invention which is substantially similar in construction to the third embodiment just described above and in which the horizontal passages 12 are defined on opposite side surfaces of the core 7 and the ratio of the flow rate through the major pouring holes 16 to the sum of the flow rate of the molten metal flowing through the side pouring holes 17 for controlling the side flow rate and the flow rate of the molten metal flowing through the major pouring holes 16 for controlling the flow rate over the major area is made equal to the ratio of the length of the lower slit 15 to the length of the core 7 in the cast widthwise direction. The total sectional area of the lower slit 15 is made greater than the total sum of the areas of the major pouring holes 16. The diameter of each side pouring hole 17 and the diameter of each major pouring hole 16 are evaluated depending upon width and thickness of a cast to be produced and in view of production rate per unit time interval. Furthermore, the flow rate of the molten metal which can prevent the growth of the shell at each triple point is evaluated by rule of thumb so as to evaluate the diameter of each side pouring hole 17.

In this embodiment, the molten metal 5 in the tundish 8 having a predetermined head flows through each side pouring hole 17, each side pouring hole 9 and each horizontal passage 12 to each triple point on each side seal plate 2 so that the solidified shell which tends to be grown at the triple point is melted. The horizontal passages 12 guide the molten metal in the horizontal direction so that melting of the solidified shell of the cast can be avoided.

The molten metal 5 flows through the major pouring holes 16 into the upper slit 14 of the core 7 and is streamlined. Thereafter the molten metal 5 flows through the lower slit 15 into the molten bath 13 gently in the form of a sheet and uniformly in the cast widthwise direction without causing turbulence. Therefore the flow of the molten metal in the molten bath 13 becomes uniform so that melting of the solidified shells over the cylindrical surfaces of the cooling rolls 1 due to partial increase in flow rate of the molten metal can be avoided.

Furthermore, the ratio of the length W of the lower slit 15 to the length of the molten bath 13 in the cast widthwise direction is so selected as to be equal to the ratio of the flow rate of the molten metal flowing through the major pouring holes 16 to the overall flow rate so that the total side flow rate : flow rate at the major area=2S : W (where S represents a side length). As a result, the flow rate per unit time interval of the molten metal flowing into the molten bath 13 becomes uniform in the cast widthwise direction and temperature distribution in the cast widthwise direction also becomes uniform.

Thus, the temperature of the molten metal which flows gently and uniformly in the cast widthwise direction becomes uniform in the cast widthwise direction so that the growth rate of the solidified shell over the cylindrical surface of each cooling roll 1 becomes uniform in the cast widthwise direction. Therefore, continuous casting can be carried out under the same conditions in the cast widthwise direction.

The flow rate of the molten metal required for melting the solidified shells grown at the triple points on the side seal plates 2 which cause damages to the cast products and for inhibiting the growth of the same is preliminarily determined or evaluated depending upon the diameter of each side pouring hole 17. When the side flow rate varies in a practical operation due to variations of casting conditions, the flow rate can be adjusted by suitably selecting the head of the molten metal 5 in the tundish 8. Overall variations in flow rate due to the variations of the head can be controlled by varying the rotational velocity of the cooling rolls 1.

The fourth embodiment may attain the same effect by employing the cut out portions 11 in the first embodiment instead of the horizontal passages 12.

Figure 9:
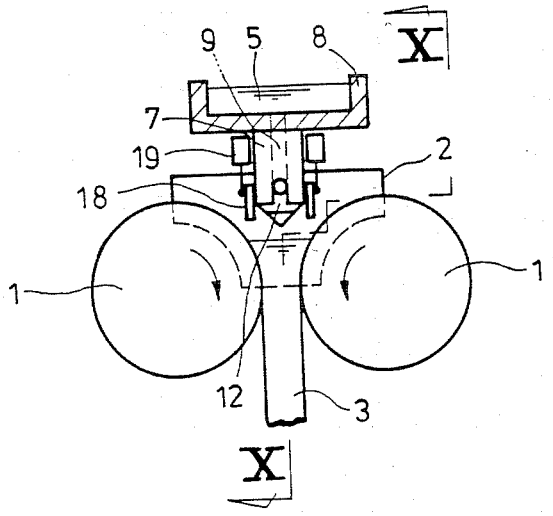
FIG. 9 is a schematic side view of a fifth embodiment of the present invention.
Figure 10:
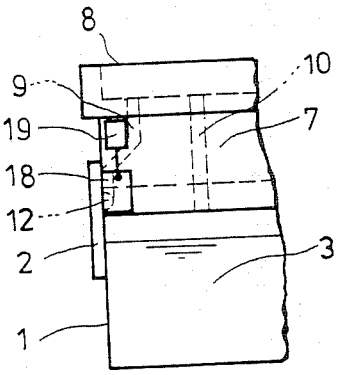
FIG. 10 is a sectional view taken along the line X—X in FIG. 9.
Figure 11:
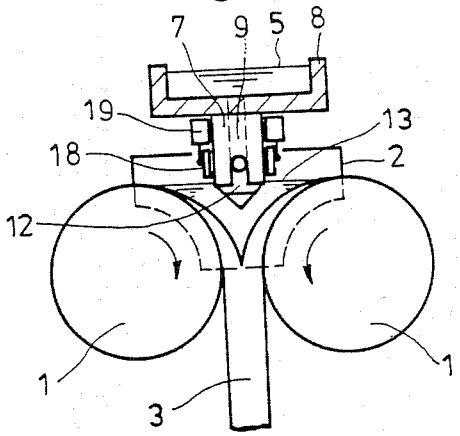
FIG. 11 is a view used to explain mode of operation of a baffle plate shown in FIG. 10.

FIGS. 9–11 show a fifth embodiment of the present invention which is a modification or variation of the second or third embodiment or is similar in construction to the fourth embodiment and in which a vertically movable baffle plate 18 is adapted to be located in front of the corresponding open end of the horizontal passage 12 and is driven by a cylinder 19.

At the start of the continuous casting operation, the cylinder 19 is energized to lower the baffle plate 18 to a position in front of the open end of the horizontal passage 12 and then the molten metal is poured. In response to increase of the surface level of the molten metal during the molten metal being gradually stored in the molten bath 13, the baffle plate 18 is raised and is maintained at a position slightly higher than the normal surface level of the molten metal as shown in FIG. 11.

Therefore, at the initial stage of the molten metal pouring with no molten metal being in the molten bath 13, the molten metal flows discharged horizontally from the horizontal passage 12 are screened by the baffle plates 18. When the molten metal 5 is stored in the molten bath 13, the flows of the molten metal discharged horizontally from the horizontal passage 12 are interrupted by the stored molten metal. Thus, in either case, the molten metal flows are prevented from directly contacting the cooling rolls 1.

It is to be understood that the present invention is not limited to the above described embodiments and that various modification may be effected without leaving the true spirit of the present invention.

As described above, according to the dual roll type continuous casting machine of the present invention, the molten metal flowing through the cut out portions defined at the opposite longitudinal ends of the core can effectively melt the solidified shells grown over the surfaces of the side seal plates and the molten metal is directly fed into the gap between the cooling rolls through the inside pouring holes. As a result, the solidified shells over the cylindrical surfaces of the cooling rolls can be protected and the triple point problem can be avoided so that the continuous casting operation can be carried out under better conditions.

Instead of the cut-out portions of the core, the horizontal passages may be used to guide the molten metal horizontally to the molten bath so that the downward flows are controlled and there is no fear of the solidified shells over the cylindrical surfaces of the cooling rolls being melted.

As a result, surface degradation of the cast due to stripped solidified shells, local variations in thickness, disconnection of cast sheet metal, damages to the side seal plates due to separated and dropping solidified shells can be prevented.

The inside pouring passage means of the core may be in the form of a slit in lieu of the pouring holes so that the molten metal in the tundish can be poured into the molten bath uniformly and gently in the form of a sheet without causing clogging. Therefore, nonuniform solidification resulting from the melting of the solidified shells grown over the cylindrical surfaces of the cooling rolls can be also prevented. Furthermore, disturbance of the surface level in the molten bath on the dual rolls can be reduced to a minimum. Thus, cast quality is considerably improved.

Since the ratio of the length of the slit to the length of the core in the cast widthwise direction is made equal to the ratio of the major area pouring rate to the overall pouring rate, the flow rate per unit time interval of the molten metal flowing into the molten bath in the cast widthwise direction can be made substantially uniform and therefore temperature distribution in the molten bath in the cast widthwise direction can be made substantially uniform. As a result, the solidified shells are grown over the cylindrical surfaces of the cooling rolls always under predetermined conditions so that a high quality metal sheet with uniform properties in both the widthwise and lengthwise directions can be continuously produced.

The baffle plates are movably disposed at the open ends of the horizontal passage on each end face of the core prevent the molten metal flow from directly contacting the cylindrical surfaces of the cooling rolls at the initial stage of the casting operation so that local growth of the solidified shells over the cylindrical surfaces of the cooling rolls can be avoided. As a result, leakage of molten metal in the molten bath can be prevented.

What is claimed is:

1. In a dual roll type continuous casting machine having cooling rolls disposed in parallel with each other, side seal plates disposed at opposite end faces of said cooling rolls to define together with said cooling rolls a molten bath and a core inserted and supported within said molten bath, an improvement comprising inside pouring passage means formed through said core for supplying a molten metal vertically into a gap between said cooling rolls and side pouring holes formed through longitudinally opposite ends of said core to open in opposed relationship with said side seal plates, each of said side pouring holes terminating in a cut-out portion to define together with the corresponding side seal plate a molten metal passage.

2. The machine according to claim 1 wherein the inside pouring means comprises a plurality of pouring holes spaced apart from each other in a cast widthwise direction.

3. The machine according to claim 1 wherein said inside pouring means is provided by slit means formed along a cast widthwise direction.

4. The machine according to claim 1 wherein said cut out portion is a horizontally extending passage in the form of an inverted T.

5. The machine according to claim 4 wherein baffle plates are movably located at open ends of said horizontal passage.

6. The machine according to claim 4 wherein said inside pouring means is provided by slit means formed along a cast widthwise direction.

7. The machine according to claim 6 wherein said slit means comprises an upper slit and a lower slit which is smaller in size than said upper slit.

8. The machine according to claim 6 wherein ratio of length of said slit means to length of said core in the cast widthwise direction is substantially the same as ratio of inside pouring rate to sum of inside pouring rate and side pouring rate.

9. The machine according to claim 8 wherein baffle plates are movably located at open ends of said horizontal passage.

* * * * *